United States Patent [19]

Bienvenu et al.

[11] Patent Number: 4,738,759

[45] Date of Patent: Apr. 19, 1988

[54] METHOD FOR PRODUCING CALCIUM OR CALCIUM ALLOYS AND SILICON OF HIGH PURITY

[75] Inventors: Gërard Bienvenu, Viuz-en-Sallaz; Dominique Dubruque, Bonne-sur-Menoge, both of France

[73] Assignee: Extramet S.A. Zone Industrielle, Cranves-Sales, France

[21] Appl. No.: 876,857

[22] PCT Filed: Sep. 27, 1985

[86] PCT No.: PCT/FR85/00266

§ 371 Date: May 29, 1986

§ 102(e) Date: May 29, 1986

[87] PCT Pub. No.: WO86/02108

PCT Pub. Date: Apr. 10, 1986

[30] Foreign Application Priority Data

Oct. 5, 1984 [FR] France ..... 84 15506
Nov. 21, 1984 [FR] France ..... 84 17941

[51] Int. Cl.[4] ..... C25C 3/02; C25C 3/36

[52] U.S. Cl. ..... 204/60; 204/69; 204/71

[58] Field of Search ..... 204/69, 71, 60, 61

[56] References Cited

U.S. PATENT DOCUMENTS 3,226,311 12/1965 Van Diest ..... 204/69
3,284,325 11/1966 Gibson ..... 204/69

FOREIGN PATENT DOCUMENTS 639728 4/1962 Canada ..... 204/69
40-12961 6/1965 Japan ..... 204/71

OTHER PUBLICATIONS

Bonomi et al., "Electrowinning of calcium metal by electrolysis of molten salt solution in calcium carbide", *Molten Salt Electrolysis Met. Prod.*, Int. Symp., 1977, 14–20.

*Primary Examiner*—John F. Niebling
*Assistant Examiner*—Ben C. Hsing
*Attorney, Agent, or Firm*—Wegner & Bretschneider

[57] ABSTRACT

The method causes the deposition of calcium or calcium alloy to a cathode by electrolysis of a calcium derivative in a bath of molten salts based on calcium halides. The calcium derivative is in solution into the molten salt bath in ionic form. For producing calcium alloy, calcium is caused to deposit on a liquid metal cathode and the calcium is alloyed in situ with the metal of the cathode to form the alloy. The method enables the production at the anode of high purity metals such as graphite carbon or silicon from calcium carbide, respectively calcium silide or calcium silicon. It is also possible to obtain high purity calcium by decomposition of the alloy obtained by vacuum distillation.

8 Claims, No Drawings

METHOD FOR PRODUCING CALCIUM OR CALCIUM ALLOYS AND SILICON OF HIGH PURITY

The present invention relates to a method for producing calcium or calcium alloys of high purity by electrolysis of a calcium derivative in a molten salt bath, the derivative being dissolved in the bath in ionic form.

Numerous methods of electrolysis in molten salts are known which allow various metals to be obtained, such as calcium, silicon, magnesium and sodium, etc, which are deposited on the cathode.

These methods do not always allow substances of adequate purity to be obtained without awkward and costly purification stages.

A "liquid cathode" method can also be adopted, and this process involves using as cathode a liquid or molten metal which is generally deposited on the base of the electrolytic tank.

On the same lines, methods for producing silicon by electrolysis or by electro-refining are also known, a good example of these methods being described in French Pat. Specification No. 2 480 796. In this method, which relates to the refining of silicon, some silicon is dissolved in a molten salt bath based on alkali and/or alkaline earth halides and nitrides from a silicon anode. The silicon thus dissolved is deposited in the cathode such that, even if this refining operation leads to high purity silicon, it is impossible to guarantee that it is free from traces of metals which are themselves also deposited on the cathode.

The desire to obtain high purity silicon which is free from metals need not be emphasised since it is known that this element is one of the main constituents of certain electronic memories and circuits.

The object of the invention is specifically to obtain high purities both with regard to the calcium and to it partner in the derivative. It involves causing the calcium or the alloy to be deposited on a cathode by electrolysis of a calcium derivative in a bath of molten salts based on calcium halides, the calcium derivative being dissolved in the bath of molten salts in ionic form.

It has been observed that the deposition of pure, that is non-alloyed calcium necessitated the application of high electric powers. Furthermore, the metal calcium is soluble in the bath of halides and has to be removed from this bath before dissolving in it. Otherwise, the electrical conductivity of the bath becomes too great and the electrolytic cell will short-circuit after a certain period of operation.

It is therefore advantageous to work with a liquid metallic cathode and the calcium formed in situ is alloyed with the metal constituting the cathode.

Aluminium, tin, copper, lead, bismuth, nickel, etc, for example, may be selected as metal constituting the liquid cathode. The metal constituting the cathode is, for example, in the molten state. These metals may be used in pure form or in a mixture. They may also be pre-alloyed with calcium to lower their melting point.

In a first variation, the metal cathode is truly liquid, that is to say the cathode is liquid from the beginning before electrolysis is initiated.

In a second variation, with a nickel cathode for example, the cathode may be solid at the beginning and may pass gradually to the liquid state during the electrolysis process as the Ca/Ni alloy is being formed.

Suitable calcium derivatives in ionic solution in the molten calcium halides include calcium nitride, calcium hydride, calcium carbide, calcium silicide or silico-calcium, calcium boride, calcium cyanide and calcium cyanamide.

$CaSi_2$ and $CaC_2$ are of particular interest as they allow silicon, respectively graphite carbon of high purity to be produced at the anode, obviously in addition to high purity calcium or calcium alloys at the cathode.

Calcium halides is the group comprising calcium chloride, calcium fluoride and mixtures thereof are selected for the electrolytic bath. Dehydrated industrial $CaCl_2$ could be used, for example. If mixtures are used, eutectic mixtures will preferably be selected. The bath may also contain other halides, for example alkaline halides, in particular chlorides or fluorides.

Molten salt baths at temperatures of between 650° and 1100° C. will be used, depending on the electrolysis conditions and on the calcium derivative treated.

The concentrations of these derivatives in the bath obviously depend on the nature of this derivative and on its solubility in the molten halide.

Thus, the concentration of $CaC_2$ in the bath is generally between 5 and 14% by weight at the above-mentioned temperatures.

Furthermore, the concentration of $CaSi_2$ (silico-calcium is a relatively common metallurgical product) is generally between 1 and 2% by weight, also at the above-mentioned temperatures.

To clarify the ideas, it is necessary to employ a theoretical 0.36 V for preparing the metal calcium directly by electrolysis of a molten salt bath at 800° C. In a liquid cathode for the preparation of the alloy of Ca with the cathode metal, a lower voltage, for example, of a theoretical 0.19 V is required for the lead/calcium alloy under the same conditions.

These values are theoretical electro-chemical values and a voltage of between 0.5 and 5 V will always be applied in practice for the same temperatures and for baths consisting of mixtures of calcium chloride and fluoride.

The calcium alloy obtained as liquid cathode is characterised by a high degree of purity and easily gives access to calcium which is also of high purity.

By distillation, in fact, in particular under vacuum, it is easy to decompose the alloy and to recover the calcium and the metal. The method is carried out, for example, under reduced pressure ($5\times10^{-2}$ to 10 HPa) at temperatures of between 700° and 1000° C.

The silicon obtained in anodic manner is characterised by a high degree of purity and it is impossible to detect traces of conventional metallic contaminants such as Fe, Al, Ca, Cu, Mg in it by traditional methods of analysis.

If there is any carbon, it is deposited in the form of graphite which surrounds the anode, forming a sponge. Its purity is also noteworthy.

The bath is advantageously regenerated to eliminate from it CaO (originating, in particular, from industrial $CaC_2$) and the other impurities which have accumulated in it. It is possible to proceed, for example, by injection of gaseous $Cl_2$, possibly in the presence of C in suspension or of a reducing gas such as methane.

The invention will now be illustrated in the following examples given by way of example.

EXAMPLE 1

5 kg of calcium chloride are placed in an Iconel cell, the calcium chloride being contained in a graphite crucible which is heated under a nitrogen stream for 2 hours until it melts.

Once the substance has melted (772° C.), the cell is closed and pumping is carried out by means of a vacuum line comprising a liquid nitrogen trap and a primary pump. The calcium chloride is brought to 950° C. under a vacuum of $10^{-1}$ HPa for 2 hours. After this treatment, the chloride is found to be completely anhydrous (% $H_2O<0.01\%$).

The cell is then placed under an argon atmosphere and 800 g of industrial calcium carbide containing 80% of pure carbide are added. A quantity of 4 kg of tin had previously been placed on the base of the graphite crucible, representing a layer of liquid tin having a thickness of 3 cm (graphite crucible $\phi=15$ cm, h=25 cm).

After dissolution of the industrial carbide with stirring for 2 hours, electrolysis is carried out by immersing into the bath a graphite anode which is isolated from the cell and from the crucible, of $\phi=5$ cm, situated at 4 cm from the liquid tin cathode, the graphite crucible being negatively polarised such that the voltage between the electrodes is kept between a practical 0.5 and 1.5 V (corresponding to a theoretical intensity of 0.2 to 0.25 V approximately). The cathode current density is between 0.6 and 1.2 A/m$^2$, that is electrolysis conditions corresponding on average to 120 A and 1 V. The electrolysis time is 5 hours.

After electrolysis, the metal alloy situated at the bottom of the crucible is drawn off and is analysed. The alloy contains 10.8% of calcium and its melting point measured by thermal analysis is 625° C., that is very close to the compound $CaSn_3$.

The anode is covered with a relatively dense graphite sponge of approximately 400 cm$^3$ containing approximately 210 g of graphite.

The calcium alloy is then distilled under a vacuum at 1000° at $10^{-1}$ HPa with a condenser temperature of 500° C. The metal obtained contains 99.2% of calcium.

The salt bath kept in the graphite crucible contains approximately 3% of CaO or equivalent which are removed by addition to the bath of approximately 200 g of anodic carbon sponge powder which is finally crushed and re-dispersed in the bath by stirring and by injection and by introducing 300 g of gaseous chlorine diluted in argon.

The bath which has also been regenerated is filtered over a porous nickel filter and is reused for subsequent production processes.

EXAMPLE 2

5 kg of eutectic mixture $CaF_2/CaCl_2$ containing approximately 15% of $CaF_2$ by weight and melting at 650° C. were placed in the same apparatus as before.

The same procedure as in Example 1 was employed except that only 310 g of industrical $CaC_2$ are dissolved and that electrolysis was carried out to 700° C. Electrolysis was carried out in the same manner, that is to say at a practical 1 V and at 120 A on average.

At the end of electrolysis, the cathode contains 4.7% of calcium, that is an alloy melting at about 480° C. The faradic yield was therefore about 95%.

The metal is recovered by distillation under a vacuum at 700° C. under $10^{-2}$ HPa with a condenser at 500° C. The calcium obtained is of a quality comparable to that in Example 1: 99.3% of purity.

The bath containing approximately 1% of CaO is regenerated by chlorination after dispersion of 100 g of sponge powder and passage of 150 g of gaseous chlorine. The bath is titrated by adding 25 g approximately of $CaF_2$.

EXAMPLE 3

2 kg of a mixture of anhydrous $CaCl_2$ and $CaF_2$ containing 18% of $CaF_2$ are melted in a graphite crucible having a diameter of 10 cm and a height of 30 cm. After melting, the mixture is brought to 700° C., and some tin constituting a molten cathode in the lower portion of the crucible is added. Some $CaSi_2$ in a proportion of 2% by weight is then added while stirring. The crucible is then polarised negatively and a further graphite electrode is placed at about 3 cm from the liquid tin cathode. The difference of potential between the electrodes is kept at 2.5 V for a total intensity of 200 A.

During electrolysis, approximately 360 g of $CaSi_2$ per hour are added at a rate of 30 g every 5 minutes. The mass of liquid tin was initially 1200 g, and a calcium and tin alloy containing 10.3% of calcium was drawn off at the end of the operation.

The calcium is then extracted by distillation under vacuum of the calcium/tin alloy.

The silicon has formed a compact deposit on the anode. The presence of silicon carbide can be detected at the interface between the anode and the deposit.

The deposit of silicon on the anode is collected and it is found that this metal is in a high state of purity. In fact, no metallic impurity is detected with the means of analysis available.

Under the conditions indicated above, the faradic yield is 81%.

EXAMPLE 4

The process described in Example 1 is adopted, but pure $CaCl_2$ at 800° C. is used.

High purity silicon is thus obtained, as before, and an alloy of calcium and tin containing 12.45% of calcium, from which the calcium can be extracted by distillation under a vacuum.

What is claimed is:

1. A method for producing calcium alloys and silicon of high purity, wherein the alloy is formed on a liquid metallic cathode and the silicon is formed on an anode by electrolysis of a calcium-silicon derivative in a molten salt bath comprising the calcium-silicon derivative and one or more calcium halides, the calcium-silicon derivative being in solution in the molten salt bath in ionic form.

2. A method according the claim 1 for producing calcium alloy and, at the anode, silicon of high purity, in which the calcium silicon derivative is calcium silicide or silico-calcium.

3. A method according to claim 1, in which the calcium halides are selected from the group consisting of calcium chloride, calcium fluoride and mixtures thereof.

4. A method according to claim 1, in which the molten salt bath is kept at a temperature of between 650° and 1100° C.

5. A method according to claim 1, in which the cathode is liquid at the beginning before electrolysis is initiated, said cathode comprising aluminum, tin, copper, lead or bismuth.

6. A method according to claim 1 for producing high purity calcium from its alloy, wherein the alloy is decomposed by distillation under a vacuum.

7. A method according to claim 1, in which the cathode is solid at the beginning and passes progressively to the liquid state during the electrolysis process as the alloy is being formed.

8. A method according to claim 7, in which the cathode comprises nickel.

* * * * *